US005230378A

United States Patent [19]

Kelley

[11] Patent Number: 5,230,378

[45] Date of Patent: Jul. 27, 1993

[54] METHOD AND APPARATUS FOR MANUFACTURING ONE-PIECE WATER JACKET CORES

[75] Inventor: Patrick M. Kelley, Indianapolis, Ind.

[73] Assignee: Navistar International Transportation Corp., Chicago, Ill.

[21] Appl. No.: 913,256

[22] Filed: Jul. 14, 1992

[51] Int. Cl.[5] ..... B22C 9/10; B22C 7/06

[52] U.S. Cl. ..... 164/16; 164/159; 164/186; 164/232

[58] Field of Search ..... 164/16, 28, 159, 180, 164/186, 228, 232

[56] References Cited

U.S. PATENT DOCUMENTS

| | | | |
|---|---|---|---|
| 2,901,792 | 9/1959 | Covitt | 164/232 |
| 3,060,534 | 10/1962 | Enzenbacher | 164/16 |
| 4,248,288 | 2/1981 | Michelson | 164/16 |
| 4,830,082 | 5/1989 | Bellis et al. | 164/16 |

FOREIGN PATENT DOCUMENTS

| | | | |
|---|---|---|---|
| 48-30210 | 9/1973 | Japan | 164/16 |
| 58-100941 | 6/1983 | Japan | 164/16 |
| 59-118244 | 7/1984 | Japan | 164/16 |

*Primary Examiner*—J. Reed Batten, Jr.
*Attorney, Agent, or Firm*—Dennis K. Sullivan

[57] ABSTRACT

A one-piece water jacket core for an internal combustion engine is formed by providing a first core box portion and a second core box portion adapted for assembly and formation of the one-piece water jacket core. The first core box portion includes a first cavity adapted to form a lower portion of the one-piece water jacket core and the second core box portion includes a second cavity adapted to form an upper portion of the one-piece water jacket core. A plurality of movable members are pivotally carried adjacent to, and preferably by, one of the core box portions. Each of the pivotal movable members includes a portion adapted to form a water jacket port and to be pivoted, after assembly of the first and second core box portions, to a position forming one of the water jacket ports in the one-piece water jacket core. The invention is particularly adapted for the formation of one-piece water jacket cores with a cold-cure process.

13 Claims, 4 Drawing Sheets

METHOD AND APPARATUS FOR MANUFACTURING ONE-PIECE WATER JACKET CORES

FIELD OF THE INVENTION

This invention relates to methods and apparatus for manufacturing one-piece water jacket cores for use in casting cylinder heads for internal combustion engines, and, more particularly, relates to methods and apparatus for forming exhaust ports in a one-piece water jacket core.

BACKGROUND OF THE INVENTION

The manufacture of cylinder heads for internal combustion engines poses difficult manufacturing problems. The cylinder head of an internal combustion engine, whether a spark-driven, gasoline internal combustion engine or a compression ignition diesel engine, is a complex article of manufacture with many requirements. The cylinder head generally closes the engine cylinders and contains the many fuel explosions that drive the internal combustion engine, provides separate passageways for the air intake to the cylinders and for the engine exhaust, and provides a separate passageway for coolant to remove heat from the cylinder head. It is desirable that the internal walls of the cylinder head between the coolant passageways and cylinder closures and exhaust manifolds permit a reliable and effective transfer of heat from the cylinder head, and it is also important that the cylinder head include minimal metal to reduce its weight and cost.

Cylinder heads are most generally manufactured by casting them from metal alloys. The casting of the cylinder head portion that encloses the cylinders carries the intake and exhaust valves and fuel injectors and provides cavities or passageways for the air intake exhaust and coolant is formed by a plurality of core elements, including a water jacket core to form the coolant passageway. The cavities for coolant, air intake and exhaust must, of course, be formed by core elements within the mold that can be removed when the casting metal solidifies.

To provide effective cooling of the cylinder head and effective air intake and exhaust from the cylinders of the internal combustion engine, the passageways for the air intake and exhaust are best interlaced with the coolant passageways within the cylinder head. To obtain maximal output from an internal combustion engine, it is necessary that the coolant passageway formed within the cylinder heads encompass the engine exhaust with coolant. Thus, in casting the cylinder head it is necessary that the exhaust ports of the cylinder head be formed with the thinnest possible metal walls that are totally bathed in an unrestricted flow of coolant. The casting of such cylinder heads requires that a water jacket core be reliably formed with casting sand extending completely around the hole which will form the outer surface of the exhaust ports of the cylinder head.

In order to obtain water jacket cores that encompass the exhaust ports, water jacket cores have been made in two portions, with two hot-box cores, an upper hot-box core with a cavity to completely form the upper portion of the water jacket core and the lower hot-box core with a cavity to completely form the lower portion of the water jacket core. Water jacket cores have been formed by the hot-box process in which the upper core box and lower core box were each filled with a core sand including a heat-curing resin. The two core boxes, after being filled, were then placed in an oven for curing generally at temperatures on the order of 500°-600° F. for several minutes. Following the curing of the upper and lower portions of the water jacket cores, the upper and lower water jacket core portions were removed from their respective core boxes, and the interfacing surfaces of the upper and lower water jacket core portions were rubbed on a leveling plate, with core fins being removed for all locations. One, or both, of the interfacing surfaces of the water jacket core box portions were pressed against a plate with adhesive on it. The lower water jacket core portion was set in an assembly fixture, with its interfacing surface presented for assembly. The interfacing surface of the upper water jacket core portion was then manually positioned on the interfacing surface of the lower water jacket core portion with the adhesive therebetween, and the two portions were manually aligned. The assembled water jacket core portions were then carried through an oven at several hundred degrees to cure the adhesive.

After the adhesive had cured, the assembled water jacket core was removed from the assembly fixtures and coated with a refractory wash and again sent through the oven for curing. Upon curing of the refractory wash, the water jacket core was then ready for use in casting the cylinder head assembly, as set forth, for example, in U.S. patent application Ser. No. 07/490,809 filed Mar. 7, 1990 and now U.S. Pat. No. 5,119,881.

This prior method of manufacturing water jacket cores presented a number of problems. First, the core boxes used in this prior method were difficult to maintain and expensive to build because of their exposure to the temperatures needed to cure the core sand and adhesive. In addition, the core boxes, and the core portions within the core boxes, were susceptible to warping due to the temperature changes; the core portions removed from the cooled core boxes were frequently warped; and the surfaces formed on the water jacket core portions for locating the water jacket core within the core assembly used to cast the cylinder head were frequently out of position, resulting in variations in metal thickness within the cylinder head and a requirement to include excess metal thickness into the design of the cylinder head walls to avoid cylinder head wall portions which may be too thin. In addition, assembly of the upper and lower water jacket core portions manually introduced further unreliability and required further design compromises. Variations in operator attention, variations in adhesive viscosity and the amount of adhesive used in gluing the water jacket core portions, and unreliability in obtaining a complete coating of adhesive at the interfaces all resulted in penetration of metal during the pouring into the interface at the glue line between the upper and lower water jacket portions, and this resulted in the formation of a metal fin in the coolant passageway which would frequently prohibit coolant circulation around the exhaust port.

In addition, this prior method required the use of a large gas-fired oven to cure the core sand and adhesive, an inventory of fixtures for the assembly of the upper and lower water jacket core portions, the use of a substantial amount of production floor space and four or five men. Furthermore, the time consumed in preparation of the water jacket core portions, the application of adhesive thereto, the assembly thereof, and the adhesive cure presented a bottleneck in the cylinder head manufacturing process.

SUMMARY OF THE INVENTION

The invention provides a means for forming a one-piece water jacket core for an internal combustion engine by providing a first core box portion and a second core box portion adapted for assembly to form the one-piece water jacket core. The first core box portion includes a first cavity adapted to form a lower portion of the one-piece water jacket core and the second core box portion includes a second cavity adapted to form an upper portion of the one-piece water jacket core. A plurality of movable members are pivotally carried adjacent to, and preferably by, one of the core box portions. Each of the pivotal movable members includes a portion adapted to form a water jacket exhaust port and to be pivoted, after assembly of the first and second core box portions, to a position forming one of the water jacket exhaust ports in the one-piece water jacket core.

Preferably the plurality of movable members are pivotally mounted in a line along one side of one core box portion, and each of the movable members includes a water jacket exhaust port-forming portion adapted for entry into one of a plurality of openings into the core box cavity that are formed at the interface between the assembled first core box portion and second core box portion and thereby form a water jacket exhaust port. Each of the plurality of movable members also preferably includes a seal-forming portion adapted to be seated at and close the opening formed at the interface of the first and second core box portions.

The invention is particularly adapted for the formation of one-piece water jacket cores with a novel cold-cure process described below. In the preferred embodiments adapted for use with the cold-cure process, the upper core box portion includes, in its upper surface, a plurality of gas-receiving bores which open into the core box cavity, and the core-forming means further comprises a gas distributor adapted to be seated on the upper surface of the upper core box portion and to mate a plurality of gas injectors with the plurality of gas-receiving bores in the upper core portion when seated. The gas distributor can also have a plurality of locking elements positioned to engage the plurality of movable members when their water jacket exhaust port-forming portions are positioned within the cavity and to thereby lock their seal-forming portions in their seated positions which seal the plurality of openings.

The basic method of the invention includes the steps of providing a first core-forming portion and a second core-forming portion for a one-piece water jacket core, assembling the first and second core-forming portions to provide a core box enclosure with a cavity to form the one-piece water jacket core and with a plurality of openings into the cavity formed by one or more of the core-forming portions, providing a plurality of pivotable water jacket port-forming members, preferably carried by one of the core-forming portions, with each of the pivotable water jacket port-forming members being adjacent one of the openings, pivoting the plurality of water jacket port-forming members through the plurality of openings to provide portions of the water jacket port-forming members within the cavity of the core box enclosure and to close the plurality of openings, filling the core-forming enclosure with a curable core material, curing the core-forming material, pivoting the plurality of water jacket port-forming members to remove them from within the cavity of the core box, and deassembling the first and second core box portions and removing the one-piece water jacket core.

In the preferred cold-cure method of the invention, the core box enclosure is provided with a plurality of passageways into the cavity and after filling the core-forming enclosure with the curable core-forming materials, a curing gas is injected into the plurality of passageways and into the cavity to cure the core-forming material. In the preferred method employing the cold-cure process, the upper core box forming portion is provided with a plurality of gas-receiving bores between its upper surface and the core cavity. A gas distributor, including a plurality of gas injectors and a plurality of member locking elements, is positioned on the upper core box portion after the plurality of water jacket port-forming members have been pivoted through the plurality of openings into the cavity of the core box; the plurality of gas injectors is mated with the plurality of gas-receiving bores; and the plurality of water jacket port-forming members is locked to the plurality of openings with the plurality of member locking elements. After filling the cavity of the core box with the curable core-forming material, the curing gas is injected into the cavity to cure the core-forming material. After the core-forming material is cured, the gas distributor is removed, the plurality of port-forming members are pivoted from within the core box, and the core box is deassembled to remove the one-piece water jacket core formed thereby. The resulting one-piece water jacket core is thereafter ready for inspection and assembly into core assembly for the casting of an internal combustion engine cylinder head, as for example, by the method disclosed in U.S. patent application Ser. No. 07/490,809 filed Mar. 7, 1990.

The invention provides a number of substantial advantages. The application of adhesive and manual assembly of the water jacket core from two pieces is eliminated thereby eliminating mismatched assemblies, the possibility of fins that can impede water circulation within the internal combustion engine, and particularly around the exhaust port, and the assembly tooling and labor. Furthermore, the preferred cold-cure method of the invention eliminates heat to cure the water jacket core and eliminates core box and core warping, core box maintenance and the environmental dangers associated with prior heat curing methods. Furthermore, elimination of the hand assembly and curing operations cuts the labor by 70% to 80%, removes a bottleneck in the manufacture of cylinder heads and reduces foundry floor space requirements by 9,000–10,000 square feet.

Other features and advantages of the invention will be apparent from the drawings and more detailed description which follows.

DESCRIPTION OF THE PREFERRED EMBODIMENTS OF THE INVENTION

This invention provides a method and apparatus applicable to the manufacture of one-piece water jacket cores for use in the casting of the cylinder heads for many internal combustion engines. Accordingly, core-forming portions of the invention can have many configurations and arrangements of elements, depending upon the design of the internal combustion engine. It is an advantage of the invention that it provides reliable coolant flow within the cylinder head of an internal combustion and provides designers of internal combustion engines with greater flexibility in the design of an internal combustion engine through a more flexible manufacturing process and a more reliable formation of the heat-transferring walls within the internal combustion engine. Thus, while one preferred embodiment of the invention is described below, the principles of the invention may be used by those skilled in the art in ways other than those described to achieve improved manufacturing processes and improved internal combustion engine cylinder heads.

Figure 1:
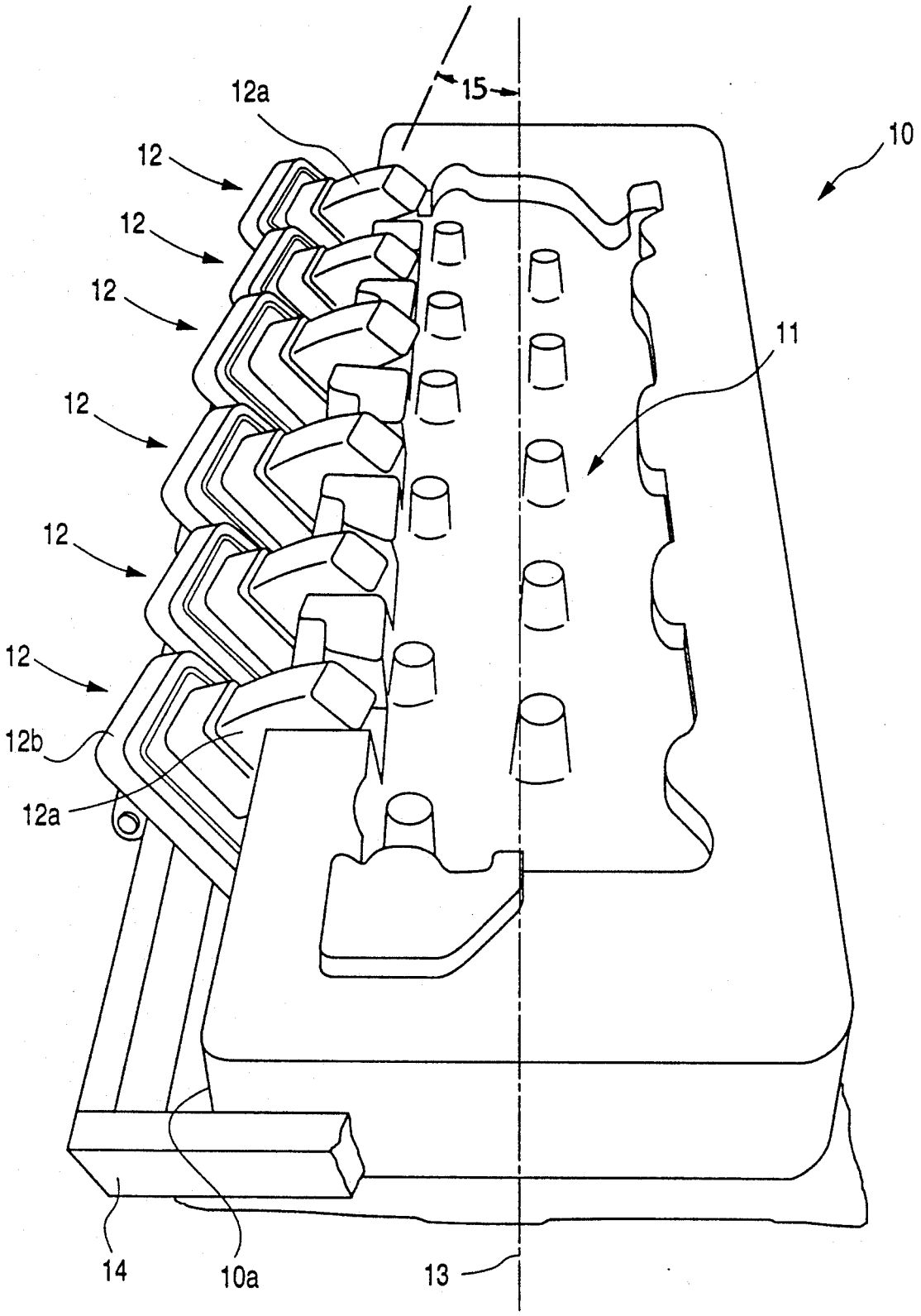
FIG. 1 is a perspective view of one preferred core box portion of the invention for the formation of a one-piece water jacket core.

FIG. 1 is a perspective view of one preferred core box portion for use in the invention to provide a one-piece water jacket core. The core box portion 10, shown in FIG. 1, includes a cavity forming portion 11 adapted to form a lower portion of a one-piece water jacket core. As shown in FIG. 1, a plurality of movable members 12 are pivotally carried by the core box portion 10. Each of the movable members 12 includes a portion 12*a* adapted to form a water jacket exhaust port and to be pivoted after assembly of the core box, as shown in the other drawings and described below, to a position within the core box cavity forming one of the water jacket exhaust ports in the one-piece water jacket core.

As shown in FIG. 1, the plurality of movable members 12 are preferably pivotally mounted in a line along one side 10*a* of core box portion 10. The water jacket exhaust port-forming portion 12*a* of each of the plurality of movable members 12 is adapted for entry into one of a plurality of openings 16 (FIG. 2) formed at the interface between the core box portion 10 and a second core box portion 20 that includes a second cavity 21 adapted to form the upper portion of the one-piece water jacket core when the second core box portion is assembled on the first core box portion 10. Each of the movable members 12 further includes a seal-forming portion 12*b* adapted to be seated at and close the opening 16 formed at the interface between the first and second core box portions. As shown in FIG. 1, each seal-forming portion 12*b* carries an O-ring seal and can be adapted to seal an opening against pressures up to about 100 psi.

In the embodiments shown in FIG. 1, each of the movable members 12 is mounted to the core box portion 10 so that it pivots on an axis that lies at 75° with respect to the centerline of the internal combustion engine, which is indicated in FIG. 1 by dashed line 13.

As shown in FIG. 1, and in greater detail in FIG. 3, each of the plurality of movable members 12 is pivotally mounted at one side 10*a* of the core box portion 10 and is operated by a common actuator 14, as more fully described below.

Figure 2:
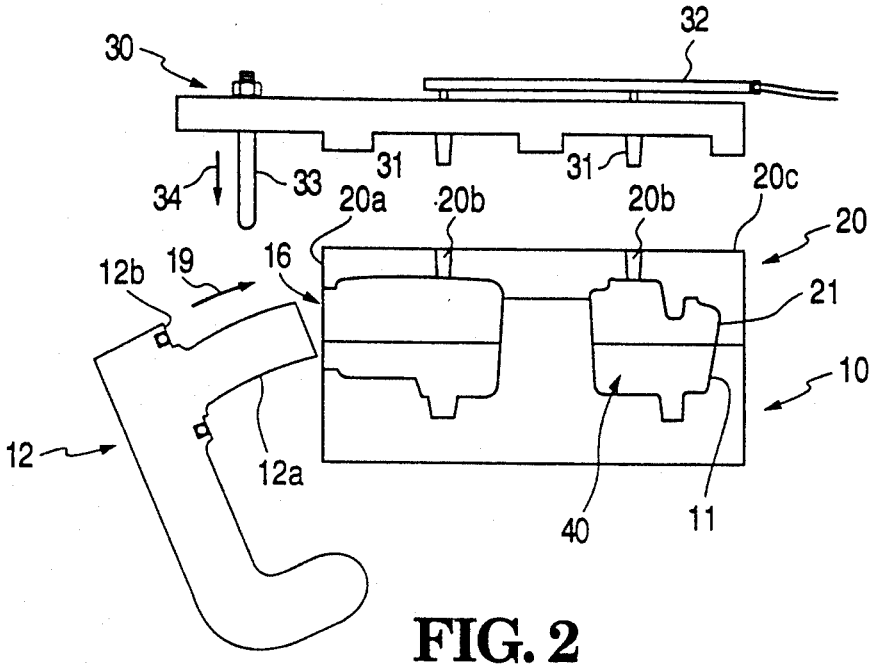
FIG. 2 is a simplified cross-sectional diagram of the elements of the invention.
Figure 3:
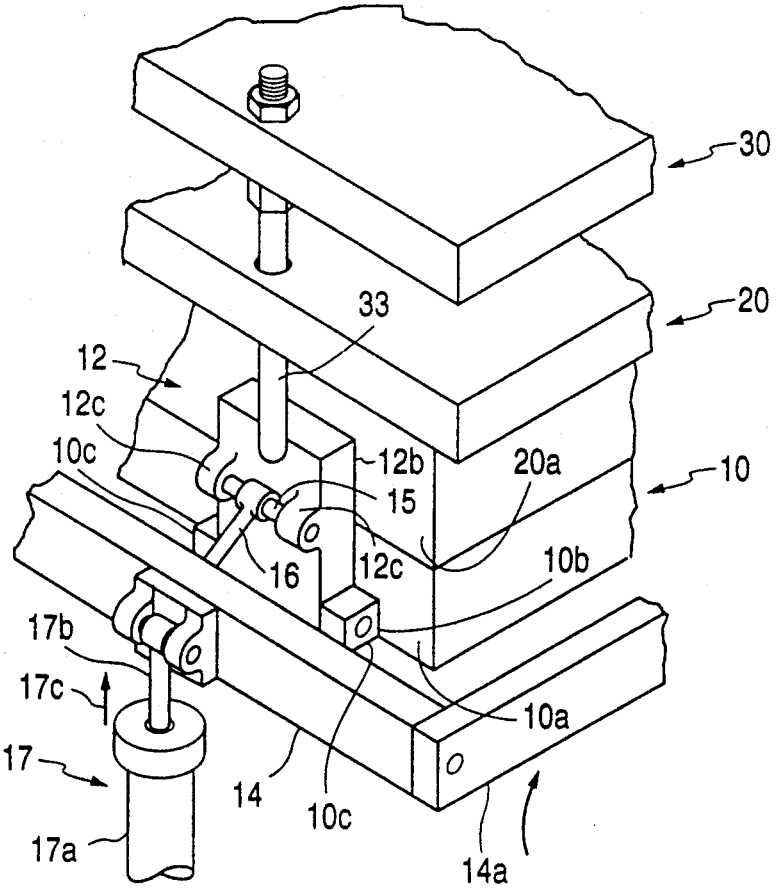
FIG. 3 is a simplified perspective view of the elements of the invention to illustrate their position when the core box is being filled with core-forming materials.
Figure 4:
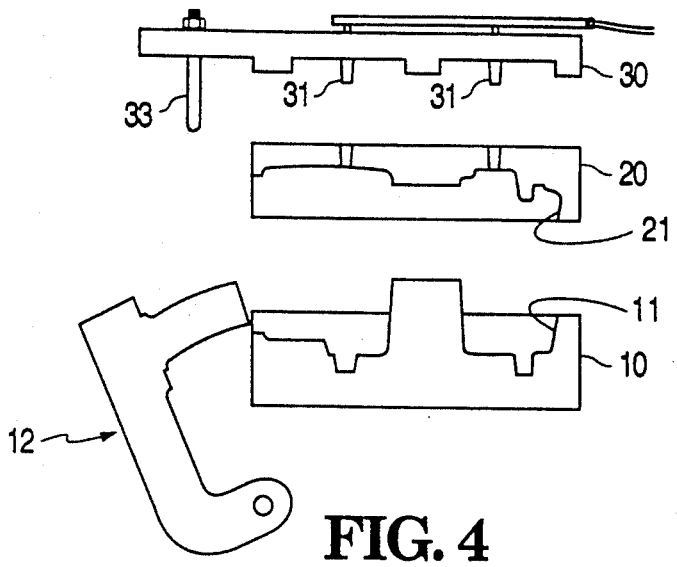
FIGS. 4–9 are simplified cross-sectional drawings to illustrate the operation of the methods and apparatus of the invention.

FIGS. 2–9 are simplified diagrammatic illustrations of the method and apparatus of this invention. FIG. 2 is a simplified cross-sectional view of the elements of a preferred system of the invention which, in the preferred method of the invention, operate in a sequence shown in FIGS. 4–9. While the movable members 12, shown in FIGS. 2 and 4–9, are illustrated as separate and detached from core box portion 10, it should be understood that in preferable systems of the invention the plurality of movable members 12 will be pivotally connected with the first core box portion 10, as shown in FIGS. 1 and 3. The manner in which the plurality of movable members 12 are pivotally attached to the first core box portion 10, including any angles their pivotal axes may have with respect to the centerline of the one-piece water jacket core or the cylinder head is determined by the cylinder head and internal combustion engine design. One advantage of the invention is that ports can be formed in the one-piece water jacket core lying at variable angles with respect to the central axis of the one-piece water jacket core, and the method and apparatus of the invention permits increased flexibility in the design of internal combustion engines.

Turning now to FIG. 2, the means of this invention providing a one-piece water jacket core for an internal combustion engine includes a first core box portion 10 and a second core box portion 20, which, upon assembly, form a one-piece water jacket core. The first core box portion 10 includes a first cavity 11 adapted to form the lower portion of the one-piece water jacket core and the second core box portion 20 includes a second cavity 21 adapted to form an upper portion of the one-piece water jacket core. A plurality of movable members 12, one of which is shown in cross-section in FIG. 2, are mounted to pivot as shown by the movement indicating arrow 19. As noted above and shown in FIGS. 1 and 3, the plurality of movable members are preferably pivotally carried by one of the core box portions, preferably by the lower first core box portion 10. Each of the movable members 12 includes a portion 12*a* adapted to form an exhaust port in the one-piece water jacket core when pivoted into the cavity 40 that is formed after assembly of the first and second core box portions, 10 and 20 respectively. As shown in FIG. 1 and indicated in FIGS. 2–9, the plurality of movable members are pivotally mounted in a line along one side 10*a* of the core box portion 10, and each of the water jacket exhaust port-forming portions 12*a* of the movable members is adapted for entry into one of a plurality of openings 16 formed at the interface between the first core box portion 10 and the second core box portion 20 when assembled. In addition, each of the movable members 12 includes a seal-forming portion 12*b* which is adapted to be seated at and close the opening 16 formed at the interface of the first and second core box portions 10 and 20, respectively. As shown in FIGS. 1 and 2, the movable members 12 may be formed with a groove in the surface interfacing the first and second core box portions 10 and 20, respectively, and may be provided with an O-ring, or elastomeric gasket, to provide a seal around the opening 16 to prevent the escape of core-forming materials when the cavity 40 formed by the core box portions 10 and 20 is filled.

As noted above, each of the plurality of movable members 12 may be carried by a core box portion in any convenient manner dictated by the design of the one-piece water jacket core to be manufactured. One such method is indicated in FIG. 3, which for convenience, shows only one of the plurality of movable members 12.

As shown in FIG. 3, each of the plurality of movable members 12 is pivotally mounted on one side 10*a* of the first core box portion 10 by an axle 10*b* extending between a pair of bosses 10*c* formed on one side 10*a* of the core box 10. Each of the plurality of movable members 12 is provided with a pair of bosses 12*c* on the seat forming portion 12*b*. The pair of bosses 12*c* rotatably carry an axle 15 and a driving rod 16 which is pivotally mounted to the actuator 14 which is common to and drives the plurality of movable members 12. As shown in FIG. 3, the common actuator 14 may be driven by a hydraulic cylinder 17. The common actuator 14 may include lever portions 14*a* at each end, each of which may be rotatably carried by the first core portion 10. In operation, after the second core portion 20 is assembled and seated on the first core portion 10, hydraulic pressure can be applied to the cylinder portion 17*a* of the hydraulic cylinder 17 driving the piston portion 17*b* upwardly, as indicated by the movement arrow 17*c*, the upward movement of the cylinder piston 17*b* will rotate the common actuator 14 about an axis of rotation formed at the opposite ends of its lever portions 14*a* at each end (which are not shown in FIG. 3), and the common actuator 14, through driving rods 16, pivots the plurality of movable members 12 about their axes 10*b* until the water jacket exhaust port-forming portions 12*a* are inserted through openings 16 and into the cavity 40 formed by cavity portions 11 and 21 of core box portions 10 and 20 and the seat-forming portions 12*b* are seated on the sides 10*a*, 20*a* of the core box.

Preferred systems of the invention are adapted to use a cold-cure process and include means for locking the movable members 12 in their seated positions. FIGS. 2 and 4–9 illustrate one such preferred method and apparatus. As shown in FIG. 2, the upper second core box portion 20 can include a plurality of gas-receiving bores 20*b* in its upper surface 20*c*. The gas-receiving bores 20*b* extend from the upper surface 20*c* into the second cavity forming portion 21 of the second core-forming portion 20.

In such a preferred system, a gas distributor 30 is adapted to be seated on the upper surface 20*c* of the upper core-forming portion 20. The gas distributor 30 includes a plurality of gas injectors 31, which are connected with a gas distributing system 32 to provide a curing gas to the cavity 40 formed by the first and second core members 10 and 20 as part of the cold-cure process. The gas distributor 30 also includes a plurality of locking elements 33 positioned to engage the plurality of movable members 12 in their pivoted and seated positions when the gas distributor is seated on the second core-forming portion, as shown in FIG. 3.

Generally, after the movable members 12 have been pivoted (indicated by arrow 19 in FIG. 2) and seated on the sides 10*a* and 20*a* of core-forming portions 10 and 20, respectively, the gas distributor 30 is moved downwardly, as indicated by arrow 34 of FIG. 2, so that the locking elements 33 bear against the back surface of the seat forming portion 12*b* of the movable members 12 to prevent the seat forming portions 12*b* from moving away from the sides 10*a* and 20*a* as the cavity 40 formed by core-forming portions 10 and 20 is filled with core-forming material.

The pressures used to inject core-forming material into the internal cavities generally lies in the range of 50–100 psi, typically about 65 psi, and the locking elements must be able to withstand forces on the order of several hundred pounds, depending upon the design of the water jacket core and the area of the movable members exposed to the filling pressure for the cavity. Generally, steel rods having a diameter on the order of ⅜ to ½ inch can provide adequate rigidity to prevent the unseating of the movable elements with core filling pressures on the order of 65 psi.

Figure 5:
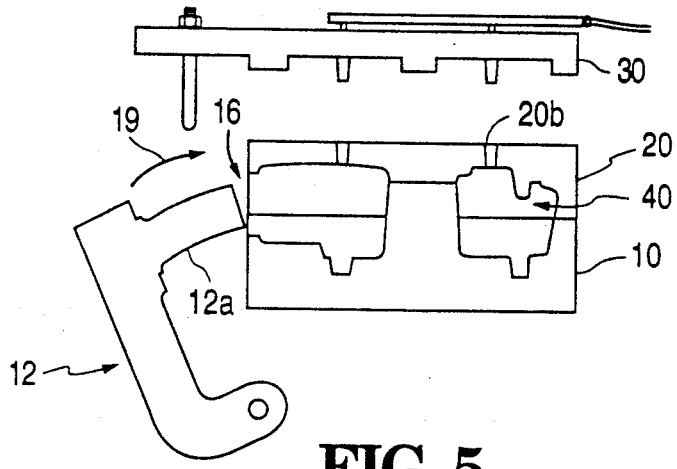
Figure 6:
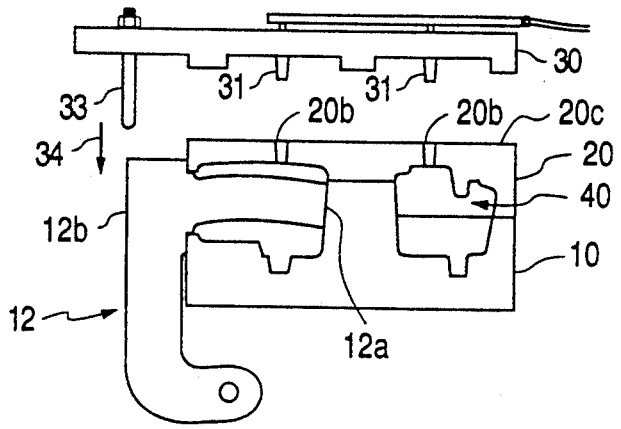
Figure 7:
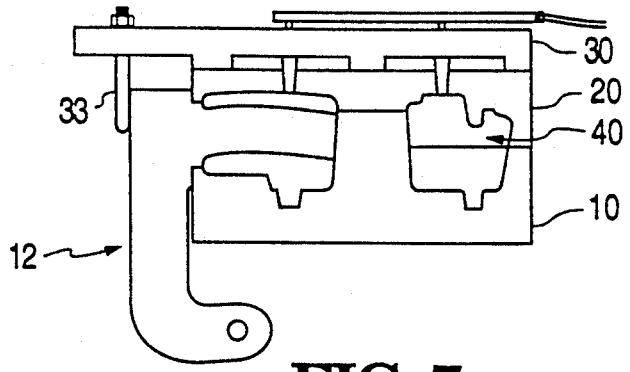

FIGS. 4–9 illustrate a preferred method of the invention. In the basic steps of the method a first core-forming portion 10 is provided. As noted above, the first core-forming portion includes a cavity portion 11 for the lower portion of a one-piece water jacket core. A second core-forming portion 20 is provided including a second cavity 21 for the upper portion of the one-piece water jacket core. As shown in FIG. 5, the first and second core-forming portions are assembled by seating the second core-forming portion on the first core-forming portion to provide a core box enclosure with a cavity 40 formed by cavity portions 11 and 21 to form a one-piece water jacket core. The core box enclosure formed by first and second core box portions 10 and 20, respectively, has a plurality of openings 16 into the cavity 40. A plurality of pivotable water jacket port-forming members 12, which may be carried by one of the core-forming portions 10 or 20 are provided, one adjacent each of the openings 16. The plurality of water jacket port-forming members 12 are pivoted as indicated by the arrow 19 of FIG. 5 so that the water jacket port-forming portions 12*a* are moved through the plurality of openings 16 to within the cavity 40 of the core box enclosure and the seal-forming portions 12*b* close the opening 16, as shown in FIG. 6.

Figure 8:
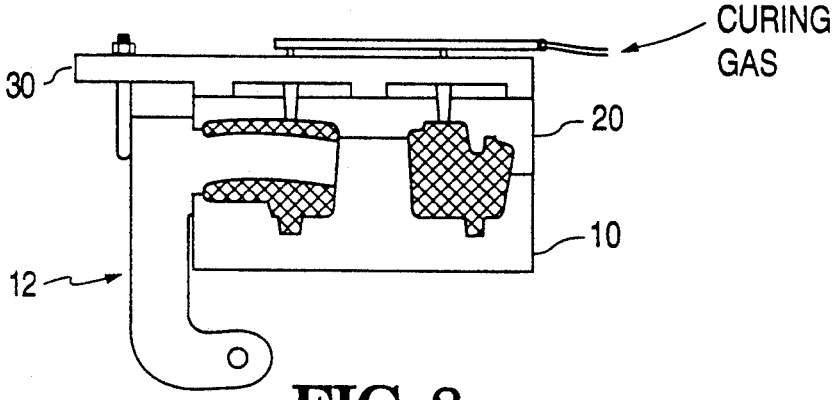

As noted above, the preferred method of the invention includes a cold-cure in which the upper (second) core box portion 20 is provided with a plurality of passageways 20*b* leading into the cavity 40 and through which a curing gas is provided into the cavity after filling to cure the core-forming material. As noted above, in the preferred cold-cure process, a gas distributor 30 is provided including a plurality of gas injectors 31 and a plurality of member locking elements 33. As shown in FIG. 6, the gas distributor is moved downwardly, as indicated by the arrow 34, and is positioned on the upper surface 20*c* of core box portion 20 after the plurality of movable water jacket port-forming members 12 have been pivoted into the position shown in FIG. 6. The gas distributor 30 is thus positioned on the upper surface of core-forming portion 20 with its plurality of gas injectors 31 mating the plurality of gas-receiving bores 20*b* and the plurality of member locking elements 33 engaging and holding the movable members 12 seated against the sides of core-forming portions 10 and 20. With core-forming portions 10 and 20 and the plurality of movable members 12 and the gas distributor 30 in the positions indicated in FIG. 7, the cavity 40 is filled with a core-forming material including a curing resin which is adapted to be cured by a curing gas in a cold-cure process. One such process is available from Ashland Chemical Company under their trademark Isocure. After the cavity 40 is filled with the curable core-forming material, a curing gas is applied to the gas distributor and injected into the cavity through the gas injectors 31 of gas distributor 30, as indicated in FIG. 8.

Figure 9:
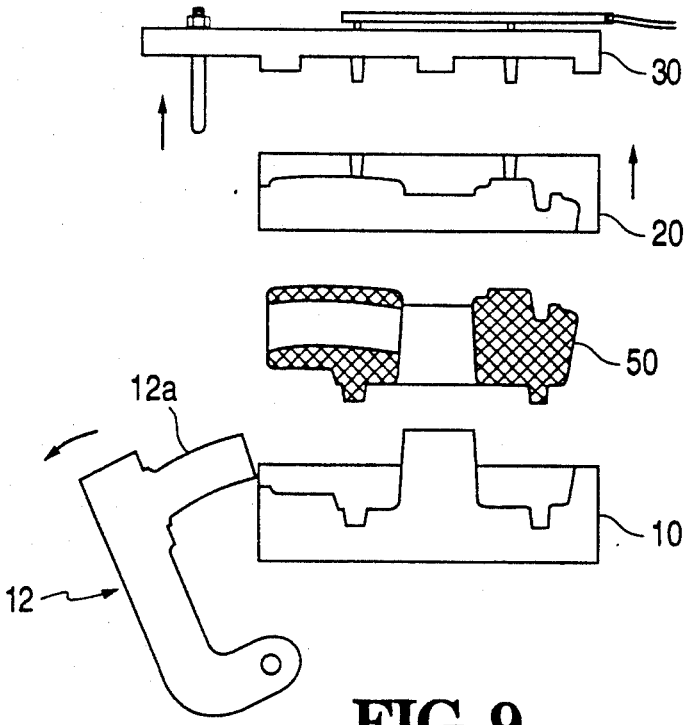

After the core-forming material has cured, the gas distributor 30 is moved upwardly and away from the core assembly, the plurality of movable members 12 are pivoted outwardly to remove the water jacket exhaust port-forming portions 12a from the openings 16 formed by core-forming portions 10 and 20, the second core-forming portion 20 is disassembled from the first core-forming portion 10 by moving it upwardly, and the one-piece water jacket core 50 is removed from core-forming portion 10, all as generally indicated in FIG. 9.

The resulting one-piece water jacket core need only be inspected for core fins and may then be processed in the further manufacture of a cylinder head, as, for example, disclosed by U.S. patent application Ser. No. 07/490,809 filed Mar. 7, 1990.

One of the advantages of the invention and its pivotal insertion of port-forming portions into a one-piece water jacket core is that the draft required on the exhaust port-forming portion of the movable members can be substantially reduced over corresponding elements that might otherwise be moved in a straight line. For example, while a port-forming portion adapted for straight line insertion into a core-forming cavity may have sides with a draft as large as 1°, the formation of ports by pivoting or rotational insertion of the port-forming portion into the core-forming cavity can reduce the effective draft to as little as about ⅛°. Furthermore, as indicated above, the preferred method does not require heat cure of the core-forming material and as a result, the one-piece water jacket cores are not subject to warping and are dimensionally stable and predictable, thereby improving the dimensional integrity of the resulting castings. Since the core box portions are not exposed to large temperature variations, they are less expensive to build and maintain. Elimination of the adhesive pasting operation improves the reliability of the castings that result from the one-piece water jacket core. The mismatches in the assembly of the two-piece water jacket cores that were frequently encountered are eliminated, which increases in the reliability of the resulting castings. In addition, the invention eliminates the assembly fixtures formally needed in the manufacture of the water jacket core, reduces labor from 4–5 men to substantially one man, and reduces the foundry floor space requirements by 9,500 square feet, by eliminating a core pasting assembly station and adhesive curing oven. Furthermore, with the invention, the manufacture of the water jacket core is no longer the operation which paces the manufacture of core assemblies for the casting of cylinder heads.

While a preferred embodiment of the invention has been described above for one internal combustion engine, the description is intended to permit the use of the invention in other internal combustion engines, and those skilled in the art will recognize that changes can be made in the described embodiments while still achieving the benefits and advantages of the invention. For example, although in preferred embodiments the movable members are pivotally carried by one of the core-forming portions, the pivoting movable members could be carried by a separate plate on which the lower core-forming portion may be positioned. Other changes may be made in the form and structure of the invention without departing from the invention as defined by the following claims and the prior art.

I claim:

1. Means for providing a one-piece water jacket core for an internal combustion engine, comprising:

a first core box portion and a second core box portion adapted for assembly to form a one-piece water jacket core;

said first core box portion including first cavity adapted to form a lower portion of the one-piece water jacket core and said second core box portion including a second cavity adapted to form a upper portion of the one-piece water jacket core; and a plurality of movable members pivotally carried by one of said core box portions, each of said movable members being adapted to form an exhaust port in the one-piece water jacket core and to be pivoted after assembly of the first and second core box portions to a position forming one of the water jacket exhaust ports in the one-piece water jacket core.

2. The means of claim 1 wherein said plurality of movable members are pivotally mounted in a line along a side of one core box portion, and wherein each of the plurality of movable members includes a water jacket exhaust port-forming portion adapted for entry into one of a plurality of openings formed at the interface between the first core box portion and second core box portion, when assembled, for formation of a water jacket exhaust port, and further includes a seal-forming portion adapted to be seated at and close said one opening formed at the interface of the first and second core box portions.

3. The means of claim 2 wherein each of the movable members is mounted to pivot on an axis lying at 75° to the center line of the internal combustion engine.

4. The means of claim 2 wherein the plurality of movable members is carried by the first core box portion.

5. The means of claim 1 wherein said second core box portion includes a plurality of passageways adapted to transmit a curing gas to the first cavity.

6. The means of claim 4 wherein said second core box portion includes a plurality of gas-receiving bores in its upper surface, said bores opening into said second cavity, and wherein said means further comprises a gas distributor adapted to be seated on the upper surface of the second core box portion, said gas distributor having a plurality of gas injectors mating the plurality of gas-receiving bores of the second core portion when seated and further having a plurality of locking elements positioned to engage the plurality of movable members carried by the first core box portion and thereby lock the seal-forming portions of the plurality of movable members in their seated positions closing said openings.

7. The means of claim 4 wherein each of the plurality of movable members is connected to a common actuator, said common actuator being connected to a driving means to move the common actuator and pivot the plurality of movable members into the plurality of openings.

8. The means of claim 7 wherein each of the plurality of movable members is pivotally mounted at one side of the first core box portion and is provided with a pair of bosses on the seat forming portion, said pair of bosses carrying an axle therebetween, and wherein said common actuator comprises a bar lying parallel to and adjacent said one side of the first core box portion, said common actuator bar pivotally carrying a plurality of member driving rods, each of said member driving rods being connected to an axle of one of said movable members so that operation of the driving means drives the common actuator bar, the plurality of driving rods, and the plurality of movable members.

9. The means of claim 8 wherein said common actuator is pivotally carried by said first core box portion and said driving means is a hydraulic cylinder having its cylinder portion connected to the first core box portion and its piston connected to said common actuator bar.

10. In a means for forming a water jacket core, the improvement comprising:

first and second core box portions adapted for assembly and formation of a core cavity and for subsequent filling to form a one-piece water jacket core, and a plurality of pivotable members carried by one of the core box portions and adapted for insertion into the core cavity, upon pivoting, of a plurality of water jacket port-forming portions through a plurality of openings formed in one or more of the first and second core box portions.

11. A method of forming a one-piece water jacket core, comprising:

providing a first core-forming portion of a core box for a one-piece water jacket core;

providing a second core-forming portion of the core box for said one-piece water jacket core;

assembling said first and second core-forming portions to provide a core box enclosure with a cavity to form a one-piece water jacket core, said core box enclosure having a plurality of openings into said cavity formed therein by one or more of the core-forming portions;

providing a plurality of pivotable water jacket port-forming members carried by one of said core-forming portions, each of said pivotable water jacket port-forming members being adjacent one of said openings;

pivoting said plurality of water jacket port-forming members through said plurality of openings, thereby providing portions of the water jacket port-forming members within the cavity of core box enclosure and closing the plurality of openings;

filling the core-forming enclosure with a curable core-forming material;

curing the core-forming material;

pivoting said plurality of water jacket port-forming members to remove them from within the cavity of the core box enclosure; and deassembling said first and second core box portions and removing the one-piece water jacket core.

12. The method of claim 11 further comprising a cold core, including the further steps of:

providing said core box enclosure with a plurality of passageways into the cavity; and after filling the core-forming enclosure with said curable core-forming material, injecting a curing gas into said plurality of passageways and into said cavity to cure the core-forming material.

13. The method of claim 11 including the further steps of:

providing said second core box forming portion with a plurality of gas-receiving bores between an upper surface and the cavity;

providing a gas distributor including a plurality of gas injectors mating the plurality of gas-receiving bores, and further including a plurality of member locking elements;

positioning said gas distributor on said second core-forming portion after the plurality of water jacket port-forming members have been pivoted through said plurality of openings, mating said gas injectors with said plurality of gas-receiving bores and locking the plurality of water jacket port-forming members to said plurality of openings with said plurality of member locking elements; and after filling the core-forming enclosure with said curable core-forming material, injecting a curing gas into said cavity to cure the core-forming material;

removing the gas distributor; and after the core-forming material is cured, pivoting and removing the plurality of water jacket port-forming members from within the core box enclosure and deassembling the first and second core box portions to remove the one-piece water jacket core.

* * * * *